US009244383B2

(12) United States Patent
Ohshima et al.

(10) Patent No.: US 9,244,383 B2
(45) Date of Patent: Jan. 26, 2016

(54) TONER SUPPLYING DEVICE AND IMAGE FORMING APPARATUS HAVING A PROJECTION WHICH INTERACTS WITH A DEPRESSION OF A TONER CONTAINER TO PREVENT ADHERING OF TONER TO AN INTERIOR OF THE TONER CONTAINER

(71) Applicants: Hironori Ohshima, Kanagawa (JP); Tadashi Ogawa, Tokyo (JP); Koichi Yamazaki, Kanagawa (JP); Atsushi Nakamoto, Kanagawa (JP)

(72) Inventors: Hironori Ohshima, Kanagawa (JP); Tadashi Ogawa, Tokyo (JP); Koichi Yamazaki, Kanagawa (JP); Atsushi Nakamoto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/465,974

(22) Filed: Aug. 22, 2014

(65) Prior Publication Data

US 2015/0063875 A1 Mar. 5, 2015

(30) Foreign Application Priority Data

Aug. 29, 2013 (JP) ..... 2013-177871
Jul. 4, 2014 (JP) ..... 2014-138843

(51) Int. Cl.
*G03G 15/08* (2006.01)

(52) U.S. Cl.
CPC ..... *G03G 15/0867* (2013.01); *G03G 15/0872* (2013.01)

(58) Field of Classification Search
CPC ..... G03G 15/0867; G03G 15/0872
USPC ..... 399/262, 258, 260, 119, 107
See application file for complete search history.

(56) References Cited

U.S. PATENT DOCUMENTS

2002/0106215 A1* 8/2002 Ban et al. ..... 399/120
2011/0305485 A1 12/2011 Oshikawa et al.
2012/0127522 A1 5/2012 Uchiyama et al.
2013/0330105 A1* 12/2013 Komatsu et al. ..... 399/262

FOREIGN PATENT DOCUMENTS

EP 1 220 052 A2 7/2002
EP 2 395 399 A2 12/2011
JP 01067660 U * 5/1989 ..... G03G 15/08

(Continued)

OTHER PUBLICATIONS

Extended European Search Report issued Feb. 24, 2015 in Patent Application No. 14181700.7.

*Primary Examiner* — Billy Lactaoen
(74) *Attorney, Agent, or Firm* — Oblon, McClelland, Maier & Neustadt, L.L.P.

(57) ABSTRACT

A toner supplying device includes: a toner container that is tubular, includes a spiral groove at an outer circumferential face, a toner discharge opening at one end in a longitudinal direction, and a depression at the other end in the longitudinal direction, and is rotationally driven to convey toner contained in the toner container along the spiral groove in the longitudinal direction to discharge the toner from the toner discharge opening; a rotational driving unit that engages with the one end of the toner container to rotationally drive the toner container to cause the toner container to discharge the toner; and a projection provided at an interior portion at which the toner container is installed, and having an inclination in which a projection amount increases toward downstream in a rotational direction of the toner container. The projection is formed to fall in the depression of the toner container.

13 Claims, 14 Drawing Sheets

(56) References Cited

FOREIGN PATENT DOCUMENTS

| | | | | | |
|---|---|---|---|---|---|
| JP | 06102763 | A | * | 4/1994 | ..... G03G 15/08 |
| JP | 8-95361 | A | | 4/1996 | |
| JP | 11-109737 | | | 4/1999 | |
| JP | 11327275 | A | * | 11/1999 | ..... G03G 15/08 |
| JP | 2001-75348 | A | | 3/2001 | |
| JP | 2008-70815 | A | | 3/2008 | |
| JP | 2012-113403 | | | 6/2012 | |
| JP | 2012-141382 | | | 7/2012 | |

* cited by examiner (T2<T1)

TONER SUPPLYING DEVICE AND IMAGE FORMING APPARATUS HAVING A PROJECTION WHICH INTERACTS WITH A DEPRESSION OF A TONER CONTAINER TO PREVENT ADHERING OF TONER TO AN INTERIOR OF THE TONER CONTAINER

CROSS-REFERENCE TO RELATED APPLICATIONS

The present application claims priority to and incorporates by reference the entire contents of Japanese Patent Application No. 2013-177871 filed in Japan on Aug. 29, 2013 and Japanese Patent Application No. 2014-138843 filed in Japan on Jul. 4, 2014.

BACKGROUND OF THE INVENTION

1. Field of the Invention

The present invention relates to a toner supplying device used in an image forming apparatus, such as a copier, a facsimile (FAX), a printer, or a multifunction peripheral having multiple functions of these and to an image forming apparatus including the same.

2. Description of the Related Art

In electrophotographic image forming apparatuses, toner as a developer is supplied from a developing device onto a latent image formed on the surface of an image bearer for development, whereby the toner in the developing device decreases. For this reason, the image forming apparatuses include a toner supplying device that supplies toner to the developing device. In the toner supplying device, toner is contained in a toner container that is tubular, that includes a toner discharge opening at an end thereof in its longitudinal direction, and whose inner wall has a spiral groove. The toner container is rotationally driven to convey the toner contained therein in the longitudinal direction along the spiral groove and discharges it from the toner discharge opening. The toner in the toner container may adhere to the inner wall face of the toner container due to the toner ingredients, the environment, and the sheet feeding conditions, and may not be discharged simply by rotational driving and thus remain inside the toner container.

Japanese Laid-open Patent Publication No. 11-109737 discloses a technique in which a driving unit is used to vibrate a toner container to reduce residual toner in the container. Japanese Laid-open Patent Publication No. 2012-141382 discloses a technique in which a unit for applying vibrations to the end (near a toner discharge opening) of a toner container to vibrate the container.

The configuration in Japanese Laid-open Patent Publication No. 11-109737 requires a driving unit for vibrating the toner container, which may lead to an increase in cost or complexity of the layout. The configuration in Japanese Laid-open Patent Publication No. 2012-141382 applies vibrations to the toner container near a toner discharge opening and thus the vibration effect on the whole toner container is small, which does not solve toner discharge failure.

There is a need to reduce toner discharge failure while ensuring low costs and space savings.

SUMMARY OF THE INVENTION

It is an object of the present invention to at least partially solve the problems in the conventional technology.

A toner supplying device includes: a toner container that is tubular, includes a spiral groove at an outer circumferential face of the toner container, a toner discharge opening at one end in a longitudinal direction of the toner container, and a depression at the other end in the longitudinal direction, and is rotationally driven to convey toner contained in the toner container along the spiral groove in the longitudinal direction to discharge the toner from the toner discharge opening; a rotational driving unit that engages with the one end of the toner container to rotationally drive the toner container to cause the toner container to discharge the toner contained therein; and a projection provided at an interior portion at which the toner container is installed, and having an inclination in which a projection amount increases toward downstream in a rotational direction of the toner container. The toner supplying device supplies the toner discharged from the toner container to a developing device. The projection is formed to fall in the depression of the toner container.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8A is an enlarged view seen from the toner container insertion side and FIG. 8B is a simplified diagram of 8A;

FIG. 12A is a schematic illustrating a state where the toner container is heavy and FIG. 12B is a schematic illustrating a state where the toner container is light;

FIG. 14A is an enlarged view indicating a state where the adjusting unit increases the elastic force and FIG. 14B is an enlarged view indicating a state where the adjusting unit reduces the elastic force.

DETAILED DESCRIPTION OF THE PREFERRED EMBODIMENTS

Embodiments of the present invention will be described with reference to the accompanying drawings. The following descriptions are examples and do not limit the scope of the invention as set forth in the appended claims. Although the skilled person will easily carry out other embodiments by changing and modifying the scope of the invention as set forth in the appended claims, the changes and the modifications are included in the scope of the invention as set forth in the appended claims by definition.

In an embodiment of the present invention, a toner supplying device includes a toner bottle and a rotational driving unit. The toner bottle is tubular and includes a spiral groove at its inner wall face, a toner discharge opening at one end in a longitudinal direction thereof, and depressions at the other end in the longitudinal direction. The toner bottle is rotationally driven to convey toner contained therein along the spiral groove in the longitudinal direction to discharge it from the toner discharge opening. The rotational driving unit engages with the end of the toner bottle to rotationally drive the toner bottle, thereby discharging the toner from the inside of the toner bottle. The toner supplying device supplies the toner discharged from the toner bottle to a developing device. In the toner supplying device, a projection with an inclination in which the projection amount increases toward downstream in the rotational direction of the toner bottle is provided at an interior portion for installing the toner bottle and is formed to fall in the depression of the toner bottle.

Figure 1:
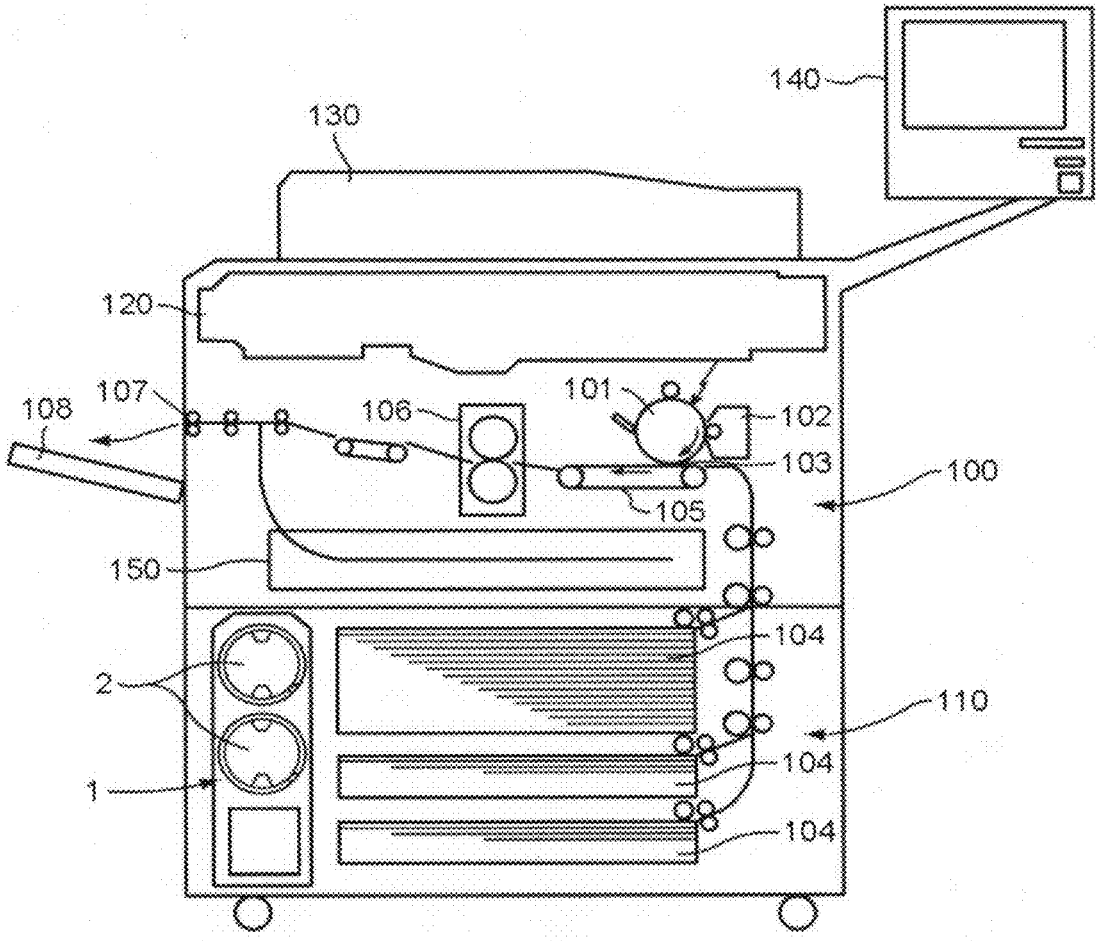
FIG. 1 is a schematic of an overall configuration illustrating an image forming apparatus according to an embodiment of the present invention.

FIG. 1 is a schematic of an embodiment of an image forming apparatus including a toner supplying device according to an embodiment of the present invention. This image forming apparatus includes a printing unit 100 as an image forming unit, a sheet feeding device 110 on which the printing unit 100 is placed, and a scanner 120 as an image reading unit arranged above the printing unit 100. An automatic original conveying device 130 and a liquid crystal display panel 140 that displays various pieces of information such as sheet feeding settings are arranged above the scanner 120. In the present embodiment, a toner supplying device 1 in which toner bottles 2 each containing supplemental toner are installed as toner containers is arranged in the sheet feeding device 110.

In the printing unit 100, a latent image corresponding to an original image read by the scanner 120 is formed on the surface of a drum-like photoconductor 101 serving as a rotatable image bearer through exposure to, for example, a laser beam. The formed latent image is developed with toner supplied from a developing device 102. The developed toner image is transferred onto a paper sheet 104 as a recording sheet that is fed from the sheet feeding device 110 and is conveyed to a transferring unit 103 opposing the photoconductor 101. In the transferring unit 103, a conveyance belt 105 rotationally driven in the counterclockwise direction in FIG. 1 is arranged opposite the photoconductor 101. A transfer member is arranged at the inner side of the belt at this opposing portion and applies transfer bias to transfer the toner image onto the paper sheet 104.

The paper sheet 104 to which the toner image is transferred is conveyed to a fixing device 106. In the fixing device 106, heat and pressure are applied to the toner image and the paper sheet 104 so as to melt the toner image on the paper sheet 104 for adherence, and thus, the toner image is fixed. For single sided printing, the paper sheet 104 to which the toner image is fixed is conveyed to an outlet 107 and is ejected onto a paper ejection tray 108. The present embodiment includes a duplex unit 150. For double sided printing, after the toner image is fixed to one side of the paper sheet 104, the paper sheet 104 is conveyed to the duplex unit 150 and is reversed. The paper sheet 104 is then conveyed to the transferring unit 103 again. At this time, a toner image for the back side of the paper sheet 104 has been formed on the photoconductor 101 and is transferred onto the back side of the paper sheet 104 on which no image is printed. The paper sheet 104 to which the toner image is transferred passes through the fixing device 105 again to fix the toner image and is ejected onto the paper ejection tray 108 through the outlet 107.

The toner supplying device 1 is described with reference to FIGS. 2 and 3. The two toner bottles 2 are installable as toner containers in the toner supplying device 1 according to an embodiment of the present invention. The number of installable toner bottles 2 is not limited to two, and at least one of them may be installed. The upper limit of the number of installable toner bottles is not limited to two and may be any number as long as the bottles are installable in the sheet feeding device 110. FIG. 3 illustrates only one side structure of the toner supplying device illustrated in FIG. 2. The toner supplying device 1 is connected to the developing device 102 via a toner supplying path 115. Toner is supplied from the toner supplying device 1 to the developing device 102 through the toner supplying path 115 at the timing of toner supply.

The toner supplying device 1 includes toner bottle holders 41 to which the toner bottles 2 are installed and fixed, gears 42 for rotating the toner bottles 2, and driving units 200 that serve as rotational driving units and rotate the gears 42 to rotationally drive the toner bottles 2. The toner bottle holders 41 each extend in the attaching and detaching direction (also called the longitudinal direction) of the toner bottles 2 indicated by an arrow D. In FIGS. 2 and 3, arrows D1, D2 indicate the attaching direction and the detaching direction of the toner bottles 2, respectively. The driving units 200 are each installed and fixed at one end 41*a* of the toner bottle holder 41. Space 47 that serves as a toner supplying area and communicates with the toner supplying path 115 is formed inside the driving unit 200. The driving units 200 include driving motors 43 as driving sources, the gears 42, and gear wheel trains (not illustrated) that connect the driving motors 43 with the gears 42. A hole 200*a* is formed rough the driving unit 200 in the attaching and detaching direction D. One end 2*a* of the installed toner bottle 2 is inserted in the hole 200*a* so that a toner discharge opening 22 to be described later is positioned in the space 47. The gears 42 each engage with the one end 2*a* of the toner bottle 2 to rotationally drive the toner bottle 2 clockwise in FIG. 2 driven by the corresponding driving motor 43.

As illustrated in FIG. 3, side walls 44A, 44B are provided at the toner bottle holder 41 opposing each other in the width direction W crossing the attaching and detaching direction D from the other end 41*b* to the center of the toner bottle holder 41. The side walls 44A, 44B are arranged upright vertically from a placement surface 41*c* of the toner bottle holder 41. When the toner bottle 2 is installed in the toner both holder 41 as illustrated in FIG. 2, the side walls 44A, 44B regulate the movement of the toner bottle 2 in the width direction W and rotatably support the toner bottle 2 so that the rotation axis O indicated by alternate long and short dashed lines is in parallel with the toner bottle holder 41. As illustrated in FIG. 3, a locking member 45 is arranged at one end 41*a* of the toner bottle holder 41 so as to vertically protrude from the setting face 41*c*, as a regulating unit that regulates the movement of the installed toner bottle 2 in the attaching and detaching direction D. The locking member 45 is configured to be removed from the placement surface 41*c* by pressing inward a release lever 46 serving as a lock releasing unit provided at the other end 41*b* of the toner bottle holder 41 in the attaching direction D1 and to release the lock on the toner bottle 2.

Figure 3:
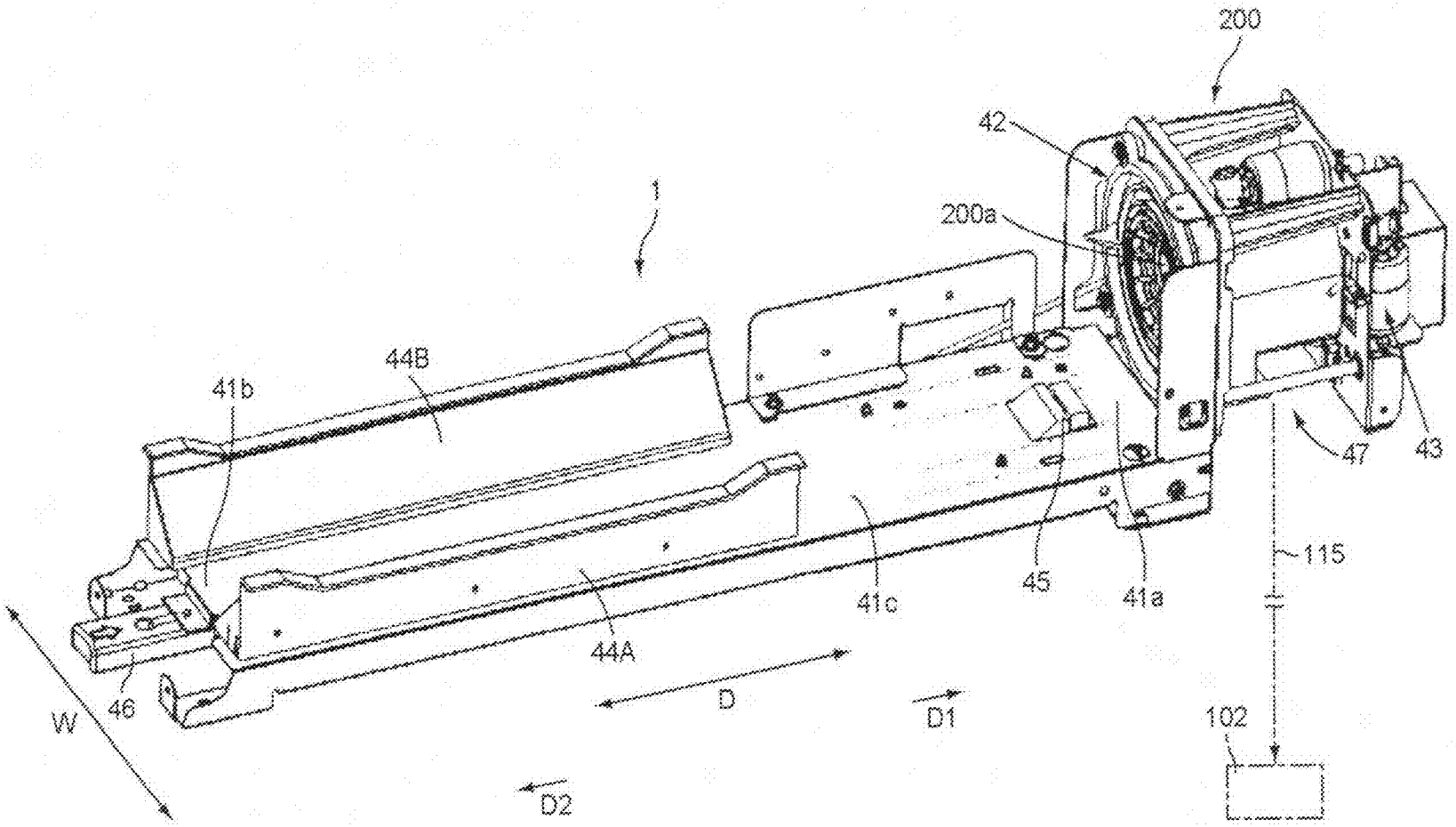
FIG. 3 is an enlarged perspective view illustrating a configuration of the toner supplying device from which a toner container is removed.
Figure 4:
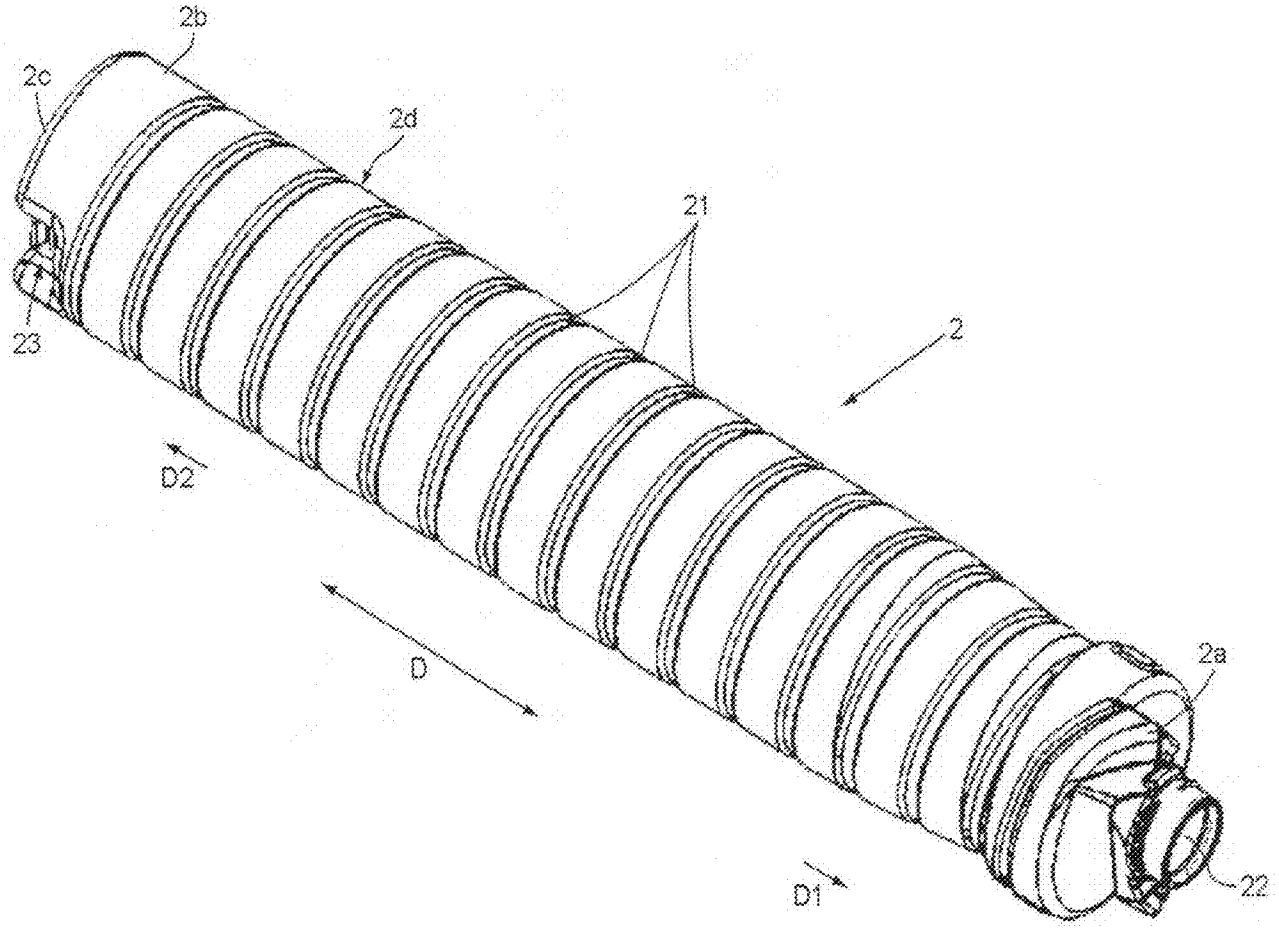
FIG. 4 is an enlarged perspective view illustrating an embodiment of the toner container used in an embodiment of the present invention.

As illustrated in FIG. 4, the toner bottle 2 is tubular. More precisely, the toner bottle 2 has a bottomed cylindrical shape extending in the attaching and detaching direction D. The toner discharge opening 22 is formed in the toner bottle 2 at the one end 2*a* in the longitudinal direction (the attaching and detaching direction D). A spiral groove 21 is formed from the other end 2*b* to the one end 2*a* of the toner bottle 2 and is recessed from an outer circumferential face 2*d* toward the inside of the bottle. The toner bottle 2 is installed in the toner bottle holder 41 illustrated in FIG. 3 from the one end 2*a* to position the toner discharge opening 22 in the space 47 through the opening 200*a*. With this setting, the movement of the toner bottle 2 is regulated in the attaching and detaching direction D by the locking member 45. The toner bottle installed in the toner bottle holder 41 is rotationally driven by driving force applied from the gear 42. In doing so, the toner therein is gradually conveyed from the other end 2*b* to the one end 2*a* along the spiral groove 21 and is discharged from the toner discharge opening 22. The discharged toner is supplied from the space 47 to the developing device 102 through the toner supplying path 115.

Figure 5:
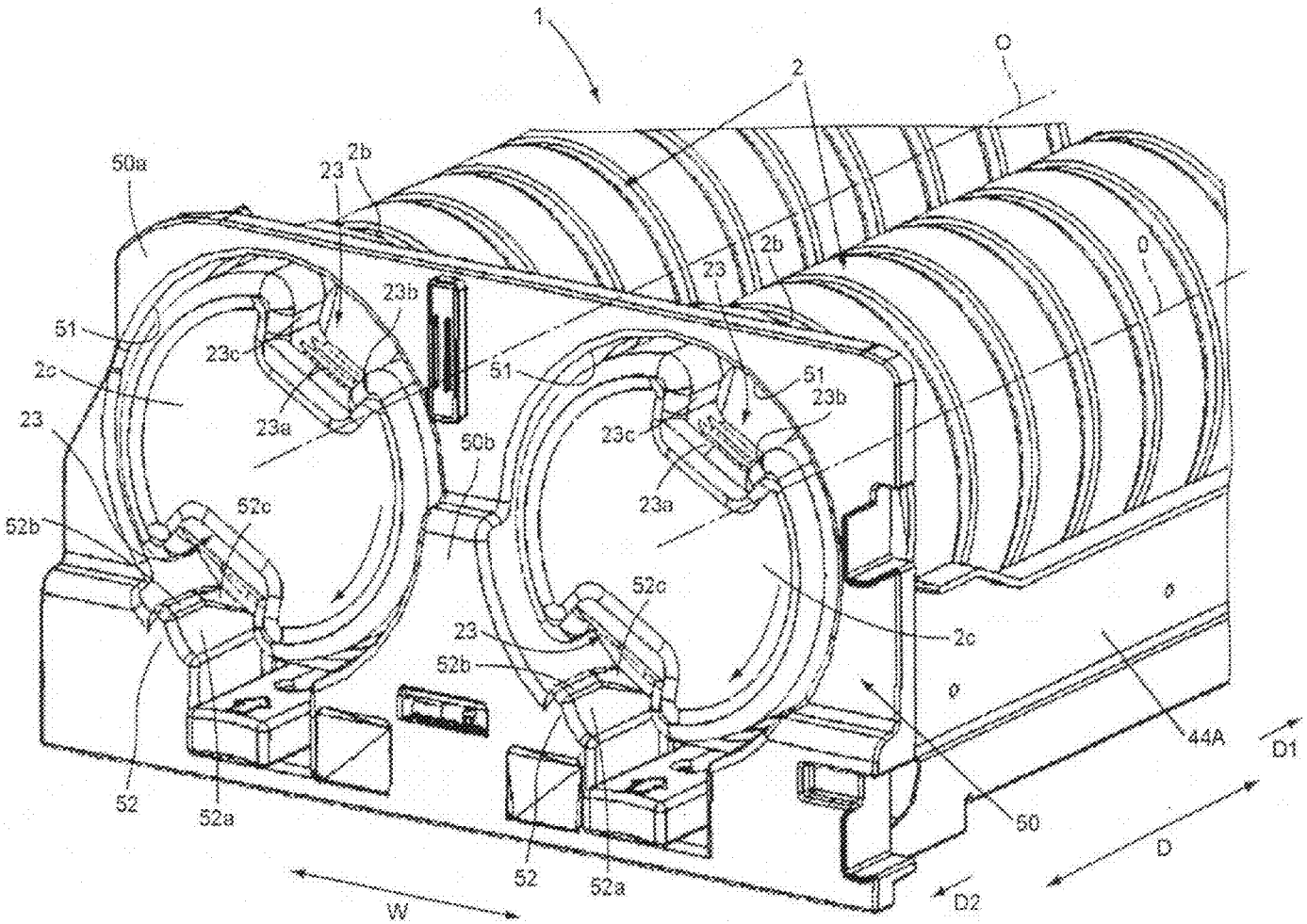
FIG. 5 is a partially enlarged perspective view illustrating a configuration of projections provided at an interior portion for installing the toner containers and depressions formed at the other ends of the toner containers, according to a first embodiment of the present invention.
Figure 6:
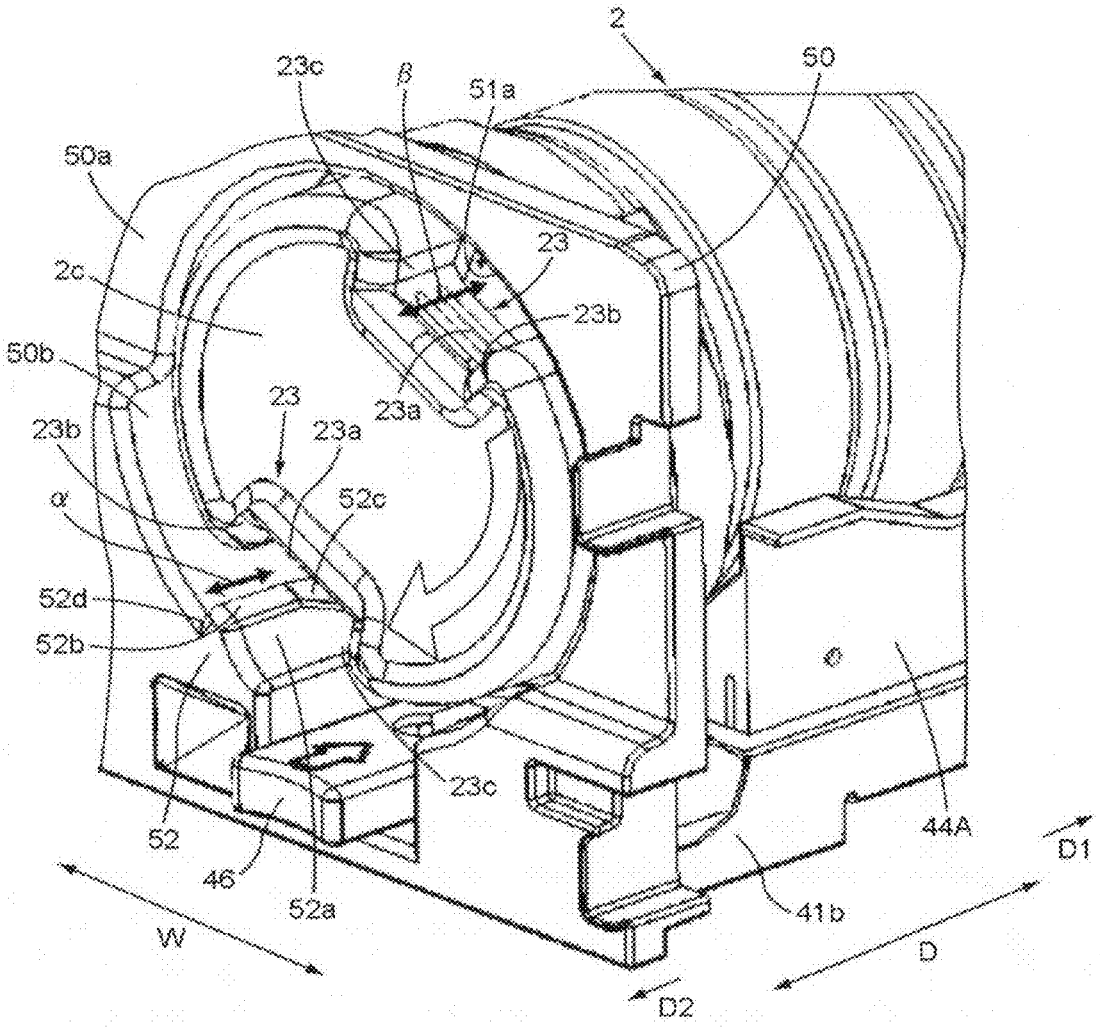
FIG. 6 is an enlarged perspective view illustrating the relation in shape and size between the projection provided at the interior portion and the depression formed at the other end of the toner container.

As illustrated in FIG. 5, depressions 23 are formed in the toner bottle 2 at the other end 2*b* in the longitudinal direction (the attaching and detaching direction D). The two depressions 23 are arranged from the other end 2*b* to reach the bottom 2*c* of the toner bottle 2 and are opposite to each other at a phase of 180 degrees. The depressions 23 are each recessed from the outer circumferential face 2*d* toward the inside of the bottle and has the shape of a sector that spreads out wide from the inside toward the outer circumferential face 2*d*. More precisely, the depression 23 includes an inner bottom 23*a* having a shorter diameter than the outer circumferential face 2*d* and inclined portions 23*b*, that incline from the inner bottom 23*a* toward the outer circumferential face 2*d*. The inner bottom 23*a* of the depression 23 is the most recessed portion and is formed to have a flat surface having a length of β in the longitudinal direction (disengaging direction) D as illustrated in FIG. 6. The depression 23 functions as a handle for an operator to attach or detach the toner bottle 2 as well as functioning as a vibration generating unit.

Figure 2:
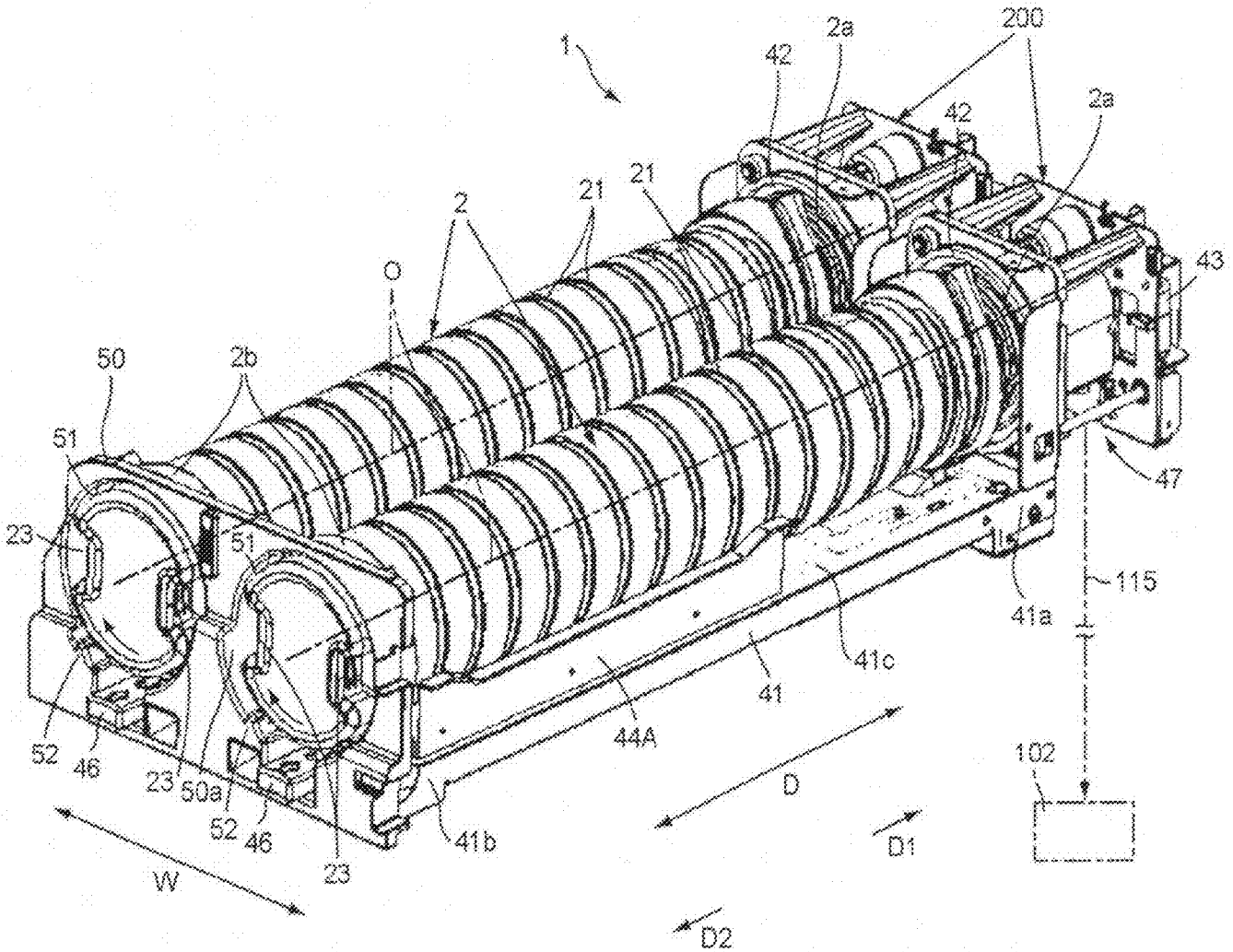
FIG. 2 is an enlarged perspective view illustrating a configuration of a toner supplying device according to an embodiment of the present invention.

As illustrated in FIGS. 2 and 5, a plate-like interior portion 50 for inserting and installing the toner bottles 2 is arranged at the other end 41*b* of the toner bottle holder 41. The interior portion 50 is fixed to the toner bottle holder 41 by welding or fastening bolts so that a plate face 50*a* is arranged vertically to the toner bottle holder 41. Substantially round installation openings 51 that are larger than the maximum outer diameter R1 (see FIG. 8) of the toner bottle 2 are formed in the interior portion 50. The toner bottle 2 is formed such that the depression 23 at the other end 2*b* faces the installation opening 51 when the toner bottle 2 is installed in the toner bottle holder 41. With this configuration, even when the toner bottle 2 is inserted in the installation opening 51 and is placed on the toner bottle holder 41, the other end 2*b* is arranged to have looseness with respect to the installation opening 51 in the diameter direction thereof. Because the two toner bottles 2 are installed in the present embodiment, the two installation openings 51 are formed in the interior portion 50. The installation openings 51 have the same shape, thus, identical reference numerals are provided to the both, and one of the installation openings 51 is described.

First Embodiment

As illustrated in FIGS. 5 and 6, a projection 52 having an inclined face 52*a* is formed at an inner portion of the installation opening 51. The inclined face 52*a* is inclined so as to gradually increase in the projection amount toward downstream in the rotational direction of the toner bottle 2 and is formed in a curve. The curvature of the inclined face 52*a* with a curve is substantially equal to the curvature of the outer circumferential face 2*d* of the toner bottle 2. With the rotational driving of the toner bottle 2, the projection 52 falls in each of the depressions 23 once during one rotation of the toner bottle 2. In other words, with the rotational driving of the toner bottle 2, the projection 52 engages with and disengages from the depression 23 periodically. This applies vibrations to the toner bottle 2 at the other end 2*b*. This engagement indicates a state where the projection 52 falls in the depression 23. The disengagement indicates a state where the projection 52 disengages from the depression 23, that is, the depression 23 gets over the projection 52. The projection 52 serves as a vibration generating unit together with each depression.

Because the one end 2*a* of the toner bottle 2 is connected with the driving unit 200, it is impossible to make the looseness larger in the diameter direction. As a result, even when vibrations are applied to the one end, it is difficult to transfer the vibrations to the entire bottle.

In contrast, with the configuration of the present embodiment, the driving unit 200 as a conventional rotational driving unit rotationally operates the toner bottle 2. In this operation, by the engagement and disengagement actions between the projection 52 and the depression 23, vibrations can be applied to the toner bottle 2 at the other end 2*b* around which looseness is provided in the diameter direction. Without requiring a driving unit for vibration, this configuration can apply vibrations to the entire toner bottle as compared with the case where vibrations are applied to the bottle at the one end 2*a* near the toner discharge opening 22. Through the application of vibrations to the toner bottle 2, the toner aggregated inside the bottle and the toner adhering to the inner face of the bottle can be thrown off. As a result, toner discharge failure can be reduced while low costs and space savings are ensured.

Furthermore the projection 52 has the inclined face 52*a* having a projection amount increasing toward downstream in the rotational direction of the toner bottle 2. This allows the projection 52 to gently come in contact with the depression 23 during the rotational driving of the toner bottle 2 and reduces the resistance to the rotation of toner bottle 2. Thus, toner discharge failure due to rotation failure can be reduced.

In addition, because the inclined face 52*a* is formed in a curve, the resistance to the rotation of toner bottle further reduced. Toner discharge failure due to rotation failure can be thus reduced.

As illustrated in FIG. 6, the projection amount of the projection 52 from the installation opening 51 toward the internal area of the opening reaches the largest at a top 52*h*. The length α of the top 52*b* in the longitudinal direction is formed to be smaller than the length β of the inner bottom 23*a* of the depression 23 in the longitudinal direction. This configuration enables the projection 52 to fall in each depression 23 of the toner bottle 2 with reliability. Vibrations can be thus applied to the toner bottle more surely to further reduce toner discharge failure. The projection 52 is formed to have the inclined face 52*a* and an inclined face 52*d* with reference to the top 52*b*. The inclination of the inclined face 52*a* positioned at the upstream side in the rotational direction of the toner bottle 2 is smaller than that of the inclined face 52*d* positioned at the downstream side in the rotational direction of the toner bottle 2. With this structure, the resistance to the rotation of toner bottle 2 is further reduced. Toner discharge failure due to rotation failure can be thus reduced.

Figure 7:
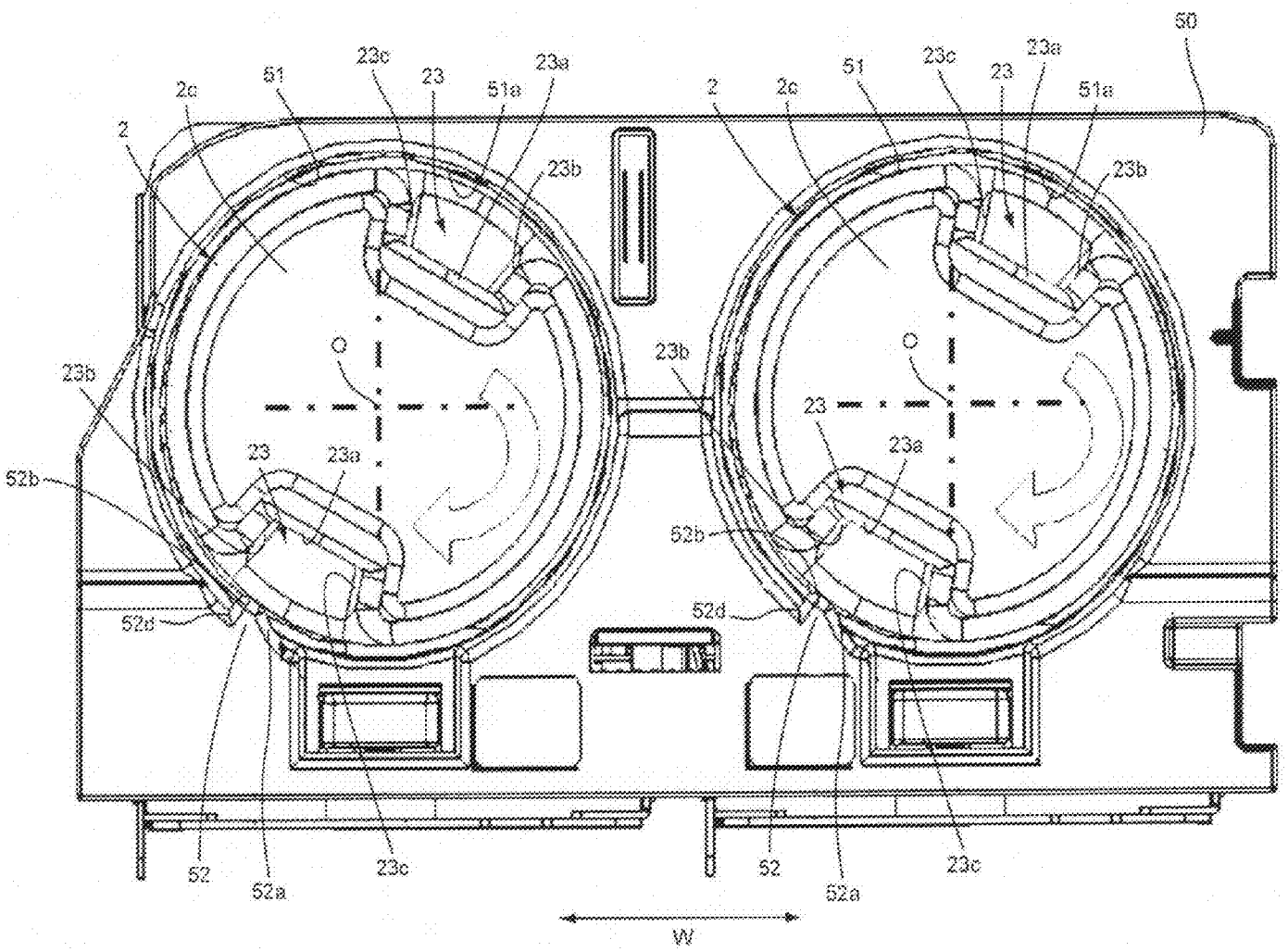
FIG. 7 is an enlarged perspective view of a configuration of the projections provided at the interior portion and the depressions formed at the other ends of the toner containers, seen from the toner container insertion side.

As illustrated in FIG. 7, the projection 52 is provided at a position of the installation opening 51 that is shifted from a position vertically below the rotation axis O of the toner bottle 2 toward downstream in the rotational direction of the bottle. If the projection 52 is arranged in the vertical direction of the rotation axis O of the toner bottle 2, that is, arranged directly below the rotation axis O of the toner bottle 2, the approach angle of the depression 23 of the toner bottle 2 with the projection 52 becomes nearly a vertical angle (close to 90 degrees). This gives a large impact to the rotating toner bottle 2. As a result, a load larger than a general load would be applied to the driving motor and the gears of the driving unit 200 that rotationally drives the toner bottle 2. However, when the projection 52 is provided at a position that is shifted from a position vertically below the rotation axis O of the toner bottle 2 toward downstream in the rotational direction of the bottle, the approach angle of the depression 23 of the toner bottle 2 with the projection 52 becomes nearly an obtuse angle during the rotational driving of the toner bottle 2, which suppresses an impact to the rotating toner bottle 2. This can suppress the load on the driving unit 200 and abrasion of the projection 52 due to sliding contact with the toner bottle 2 and can reduce toner discharge failure for a long rime. Moreover, the inclined face 52*a* is formed in a curve so as to have a curvature substantially equal to the curvature of the outer circumferential face 2*d* of the toner bottle 2. This can further suppress abrasion of the projection 52 due to sliding contact with the toner bottle 2 and can reduce toner discharge failure for a long time.

The depressions 23 constituting one side of the vibration generating unit can be each utilized as a handle. This can save the need for forming a handle and the depression and can ensure flexibility in the design of the toner bottle 2. When each depression 23 is not utilized as a handle, the number of the depressions 23 need not be two. At least one depression 23 may be formed to apply vibrations to the entire toner bottle from the other end 2*b* of the toner bottle 2 periodically during the rotation of the toner bottle 2. Because the aggregated and adhering state of the toner vary depending on the type and the amount of the toner contained in the toner bottle 2, the number of depressions 23 is not limited to two and may be increased or decreased.

As illustrated in FIGS. 5 and 6, the projection 52 has an inclined face 52*c* that is inclined so that the projection amount increases in the detaching direction D2 when the toner bottle 2 is detached from the interior portion 50. The reclined face 52*c* is formed to be downwardly inclined from the top 52*b* in the attaching direction D1. The projection amount increases from the inner wall face 51*a* of the installation opening 51 toward the top 52*b*. Specifically, in the installation portion 50, a portion 50*b* at which the top 52*b* of the projection is formed protrudes from a portion at which the inclined face 52*c* is positioned and from the end face 50*a* of the installation portion 50 in the detaching direction D2, and the top 52*b* formed to be positioned at this protrusion. With this structure, when the toner bottle 2 is detached from the interior portion 50, resistance caused while the depression 23 passes over the projection 52 becomes small, and the toner bottle 2 can be taken out smoothly.

Figure 8A:
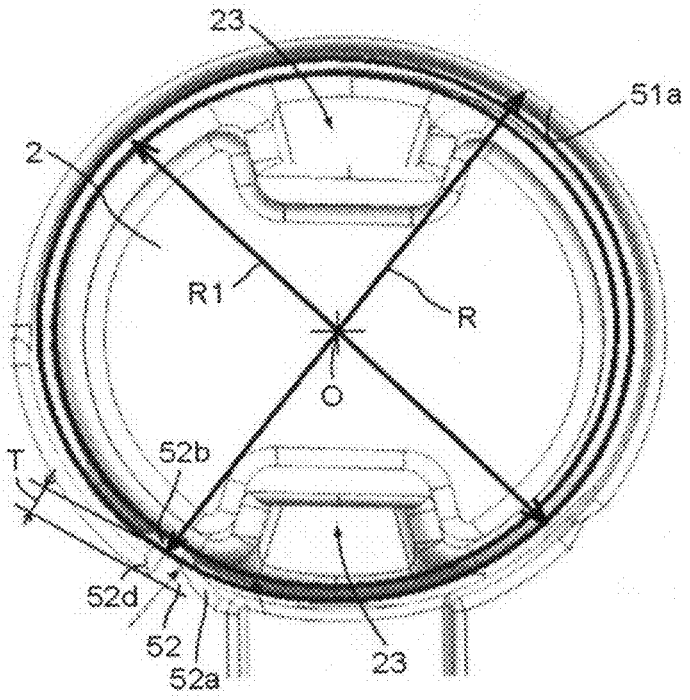
FIGS. 8A and 8B are diagrams illustrating the relation between the projection amount of the projection and the depression where
Figure 8B:
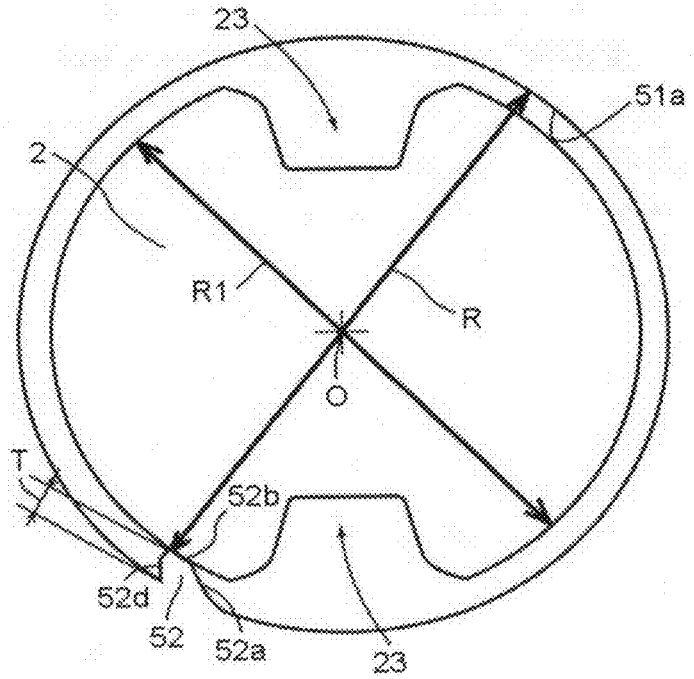

As illustrated in FIGS. 8A and 8B, a projection amount T of the projection 52 from the installation opening 51 is set in the following manner. A distance R from the top 52*b* being an end of the projection 52 to a portion of the inner wall face 51*a* of the insertion opening 51, that is, the wall face of the interior portion 50 that is opposite to the top 52*b* through the rotation axis O is smaller than the maximum diameter R1 of the toner bottle 2. In other words, the projection amount T is determined to the extent that the toner bottle 2 does not come in contact with the inner wall face 51*a* of the insertion opening 51 when the toner bottle 2 is inserted from the insertion opening 51 and carried over the projection 52. This can reduce toner discharge failure for a long time without increasing a rotational load on the driving unit 200 during the rotational driving of the toner bottle 2.

In the present embodiment, the projection amount T of the projection 52 is set to be 1 mm or larger. This can apply sufficient vibrations to the entire bottle from the other end 2*b* of the toner bottle 2 when the depression 23 passes over the projection 52 during the rotational driving of the toner bottle 2. As a result, toner discharge failure can be reduced with reliability while low costs and space savings are ensured.

The upper limit of the projection amount T (the maximum projection amount) is determined by the difference between the inner diameter of the insertion opening 51 and the maximum diameter (maximum outer diameter) R1 of the toner bottle 2 positioned in the insertion opening 51. In other words, when the distance R from the top 52*b* of the projection 52 to the inner wall face 51*a* is larger than the maximum diameter R1 of the toner bottle 2, the toner bottle 2 cannot be inserted in the insertion opening 51. Therefore, the maximum value of the projection amount T (maximum projection amount) is within a value obtained by subtracting the distance R from the maximum diameter R1.

Figure 9:
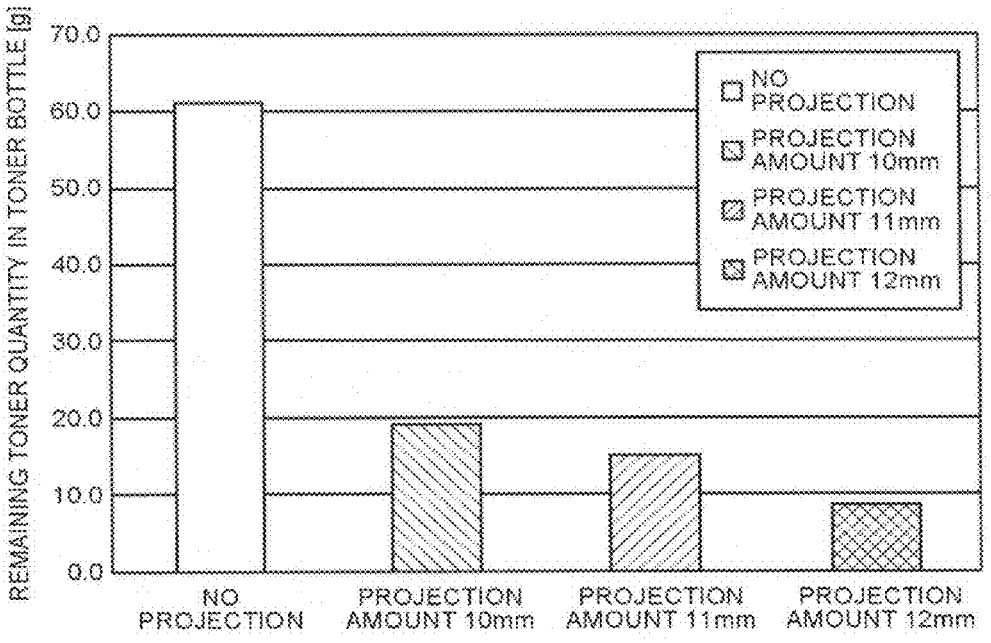
FIG. 9 is a graph illustrating the relation between the projection amount of the projection and the quantity of the remaining toner in the toner container.

FIG. 9 is a graph illustrating the relation between the projection amount T of the projection 52 and the quantity of the remaining toner in the toner bottle 2. In FIG. 9, the vertical axis indicates the quantity of the remaining toner and the horizontal axis indicates the difference in projection amount T. The quantity of the remaining toner when the toner bottle 2 has been rotationally driven in a given period of time is illustrated for each of the cases where no projection 52 is provided and the cases where the projection amount T of the projection 52 is any of 10 mm, 11 mm, and 12 mm.

As is apparent from FIG. 9, with the projection 52, the quantity of the remaining toner is drastically reduced as compared with that without the projection 52. The quantity of the remaining toner decreases in accordance with the increase in the projection amount T. It is supposed that, the larger the projection amount T, the larger the vibration applied to the toner bottle 2, and thus, the toner adhering to the inner wall face of the toner bottle 2 and the toner aggregated inside the toner bottle 2 are reduced and are discharged from the toner discharge opening 22.

Second Embodiment

The second embodiment is described with reference to FIGS. 10, 11, and 12.

In the first embodiment, regardless of the toner volume in the toner bottle 2 (the weight of the toner bottle 2), vibrations are applied to the other end 2*b* of toner bottle 2 by engaging and disengaging the projection 52 in and from the depression 23 periodically during the rotational driving of the toner bottle 2. However, the present embodiment includes a vibration intensity adjusting unit that adjusts the intensity of vibration generated with the projection and the depression according to the toner volume (the weight of the toner bottle 2). The intensity of vibration is adjustable by this vibration intensity adjusting unit. The present embodiment has the same configuration as the first embodiment except that the present embodiment includes the vibration intensity adjusting unit and that the configuration of the projection is different. Identical numerals are provided to components identical with those of the first embodiment to continue the following description.

Figure 10:
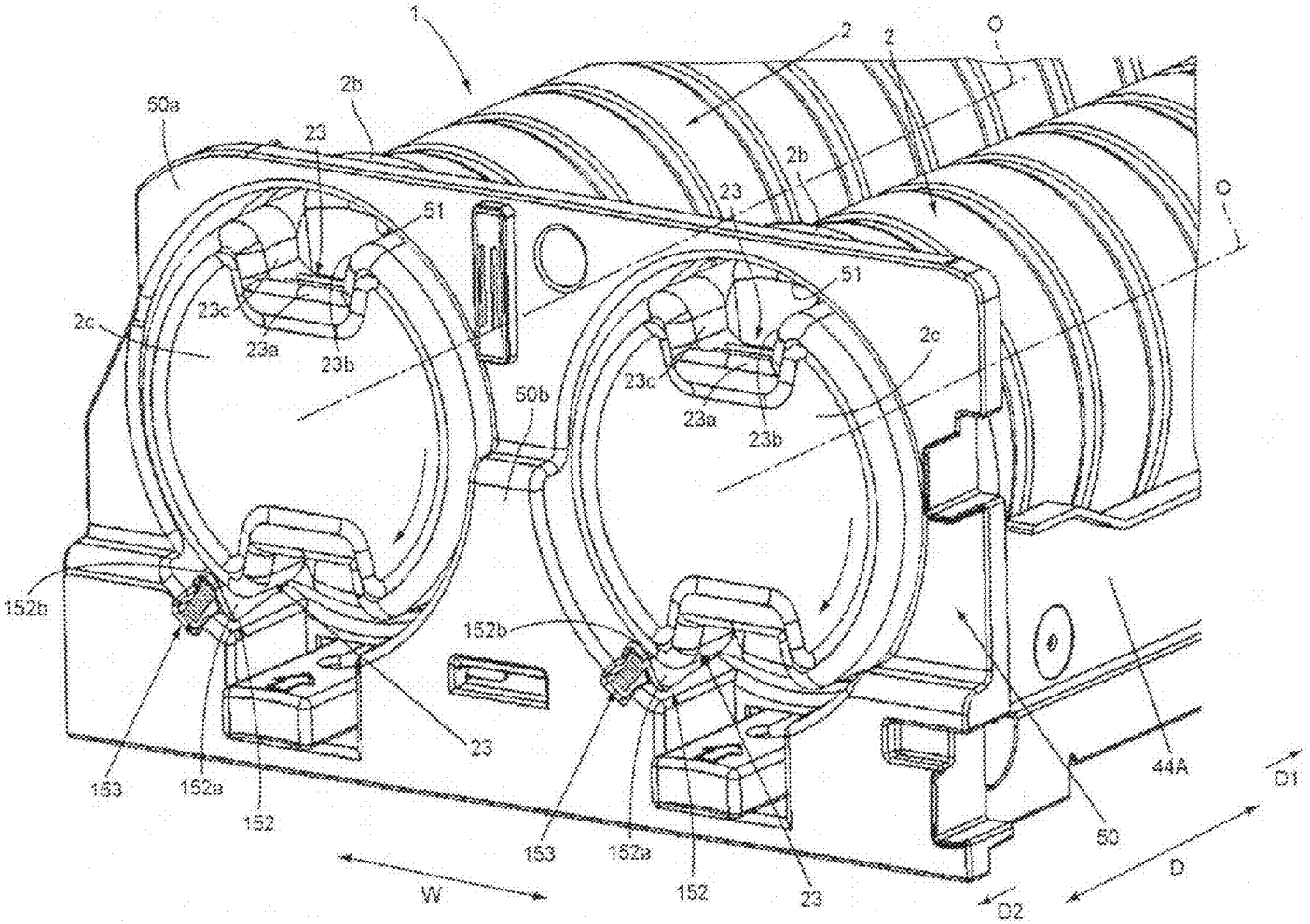
FIG. 10 is a partially enlarged perspective view illustrating a configuration of projections provided at the interior portion for installing the toner containers and the depressions formed at the other ends of the toner containers and a configuration of vibration intensity adjusting units, according to a second embodiment of the present invention.
Figure 11:
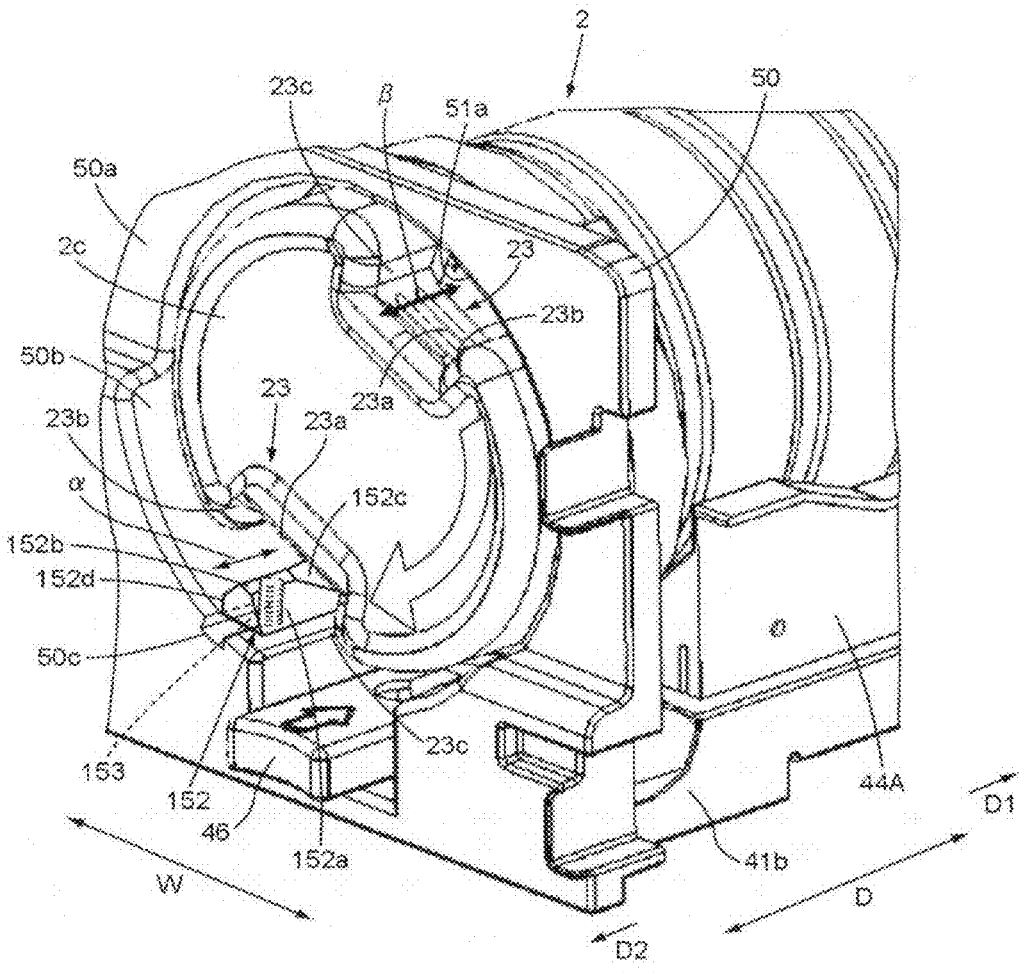
FIG. 11 is an enlarged perspective view illustrating the relation in shape and size between the projection provided at the interior portion and the depression formed at the other end of the toner container and the vibration intensity adjusting unit.

As illustrated in FIGS. 10 and 11, projections 152 each having an inclined face 152*a* are each formed at an inner portion of the installation opening 51 formed in the plate-like interior portion 50 for inserting and installing the toner bottle 2. The inclined face 152*a* is inclined to gradually increase in the projection amount toward downstream in the rotational direction of the toner bottle 2 and is formed in a curve. The curvature of the inclined face 152*a* with a curve is substantially equal to the curvature of the outer circumferential face 2*d* of the toner bottle 2. With the rotational driving of the toner bottle 2, the projection 152 falls in each of the depressions 23 once during one rotation of the toner bottle 2. In other words, with the rotational driving of the toner bottle 2, the projection 152 engages with and disengages from the depression 23 periodically. In doing so, vibrations are applied to the toner bottle 2 at the other end 2*b*. This engagement indicates a state where the projection 152 falls in the depression 23. This disengagement indicates a state where the projection 152 disengages from the depression 23, that is, the depression 23 gets over the projection 152. The projection 152 serves as a vibration generating unit together with each depression.

Because the one end 2*a* of the toner bottle 2 is connected with the driving unit 200, it is impossible to make the looseness large in the diameter direction. As a result, even when vibrations are applied to the one end 2*a*, it is difficult to transfer the vibrations to the entire bottle.

In contrast, with the configuration of the present embodiment, the driving unit 200 as a conventional rotational driving unit rotationally operates the toner bottle 2. In this operation, by the engagement and disengagement actions between the projection 152 and the depression 23, vibrations can be applied to the toner bottle 2 at the other end 2*b* around which looseness is provided in the diameter direction. Without requiring a driving unit for vibration, this configuration can apply vibrations to the entire toner bottle as compared with the case where vibrations are applied to the bottle at the one end 2*a* near the toner discharge opening 22. Through the application of vibrations to the toner bottle 2, the toner aggregated inside the bottle and the toner adhering to the inner face of the bottle can be thrown off. As a result, toner discharge failure can be reduced while low costs and space savings are ensured.

The projection 152 has the inclined face 152*a* having a projection amount increasing toward downstream in the rotational direction of the toner bottle 2. This allows the projection 152 to gently come in contact with the depression 23 during the rotational driving of the toner bottle 2 and reduces the resistance to the rotation of toner bottle 2. Thus, toner discharge failure due to rotation failure can be reduced.

In addition, because the inclined face 152*a* is formed in a curve, the resistance to the rotation of toner bottle 2 is further reduced. Toner discharge failure due to rotation failure can be thus reduced.

As illustrated in FIG. 11, the projection amount of the projection 152 from the installation opening 51 toward the internal area of the opening reaches the largest at a top portion 152*b*. The length $\alpha$ of the top portion 152*b* in the longitudinal direction is formed to be smaller than the length $\beta$ of the inner bottom 23*a* of the depression 23 in the longitudinal direction. This configuration enables the projection 152 to fall in each depression 23 of the toner bottle 2 with reliability. Vibrations can be thus applied to the toner bottle 2 more surely to further reduce toner discharge failure. The projection 152 is formed to have the inclined face 152*a* and an inclined face 152*d* with reference to the top 152*b*. The inclination of the inclined face 152*a* positioned at the upstream side in the rotational direction of the toner bottle 2 is smaller than that of the inclined face 152*d* positioned at the downstream side in the rotational direction of the toner bottle 2. With this structure, the resistance to the rotation of toner bottle 2 is further reduced. Toner discharge failure due to rotation failure can be thus reduced.

As illustrated in RIGS. 12A and 12B, the projection 152 is provided at the installation opening 51 at a position that is shifted from a position vertically below the rotation axis O of the toner bottle 2 toward downstream in the rotational direction of the bottle. If the projection 152 is arranged in the vertical direction of the rotation axis O of the toner bottle 2, that is, arranged directly below the rotation axis O of the toner bottle 2, the approach angle of the depression 23 of the toner bottle 2 with the projection 152 becomes nearly a vertical angle (close to 90 degrees). This gives a large impact to the rotating toner bottle 2. As a result, loads larger than the general loads would be applied to the driving motor and the gears of the driving unit 200 that rotationally drives the toner bottle 2. However, when the projection 152 is provided at a position that is shifted from a position vertically below the rotation axis O of the toner bottle 2 toward downstream in the rotational direction of the bottle, the approach angle of the depression 23 of the toner bottle 2 with the projection 152 becomes nearly an obtuse angle during the rotational driving of the toner bottle 2. This suppresses an impact to the rotating toner bottle 2. This can suppress the load on the driving unit 200 and abrasion of the projection 152 due to sliding contact with the toner bottle 2 and can reduce toner discharge failure for a long time. Moreover, the inclined face 152*a* is formed in a curve so as to have a curvature substantially equal to the curvature of the outer circumferential face 2*d* of the toner bottle 2. This can further suppress abrasion of the projection 152 due to sliding contact with the toner bottle 2 and can reduce toner discharge failure for a long time.

As illustrated in FIG. 11, the projection 152 has an inclined face 152*c* that is inclined so that the projection amount increases in the detaching direction D2 when the toner bottle 2 is detached from the interior portion 50. The inclined face 152*c* is formed to be downwardly inclined from the top 152*b* in the attaching direction D1. The projection amount increases from the inner wall face 51*a* of the installation opening 51 toward the top 152*b*. Specifically, in the installation portion 50, the portion 50*b* at which the top 152*b* of the projection is formed protrudes from a portion at which the inclined face 152*c* is positioned and from the end face 50*a* of the installation portion 50 in the detaching direction D2, and the top 152*b* is formed to be positioned at this protrusion. With this structure, when the toner bottle 2 is detached from the interior portion 50, resistance caused while the depression 23 passes over the projection 152 becomes small, and the toner bottle 2 can be taken out smoothly.

Figure 12A:
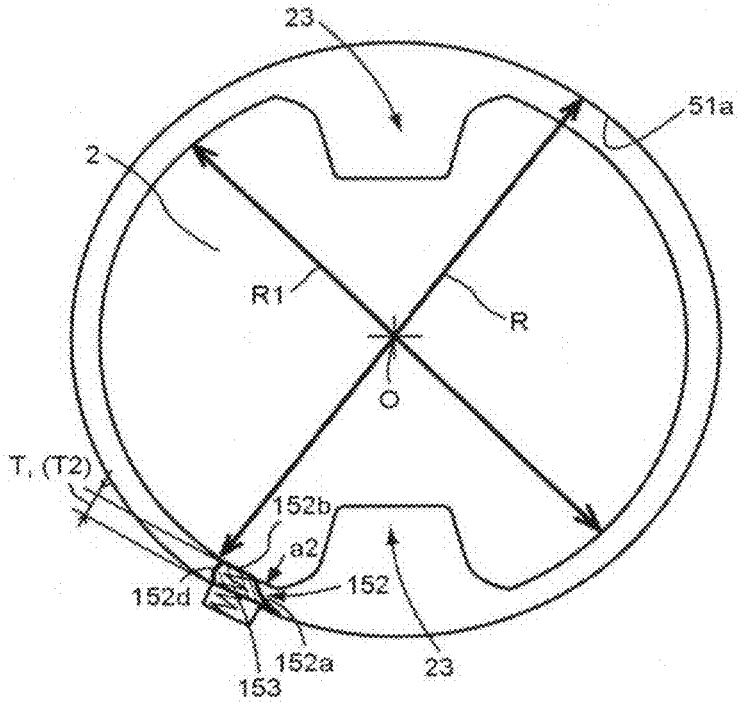
FIGS. 12A and 12B are diagrams illustrating the relation between the weight of the toner container and the projection amount of the projection where
Figure 12B:
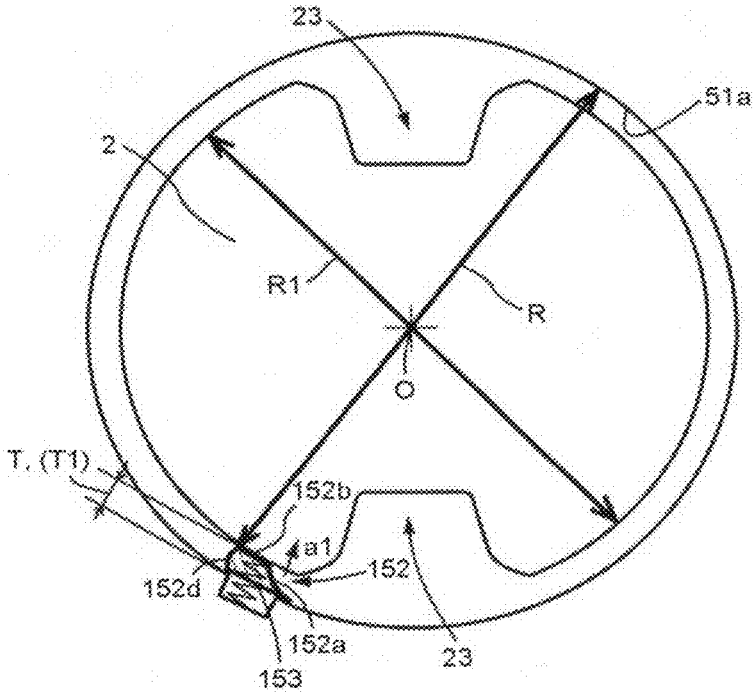

As illustrated in FIGS. 12A and 12B, the projection amount T of the projection 152 from the inner face 51*a* of the installation opening 51 is set in the following manner. The distance R from the top 152*b* being an end of the projection 152 to a portion of the inner wall face 51*a* of the insertion opening 51, that is, the wall face of the interior portion 50 that is opposite to the top 152*b* through the rotation axis O is smaller than the maximum diameter R1 of the toner bottle 2. In other words, the projection amount T is determined to the extent that the toner bottle 2 does not come in contact with the inner wall face 51*a* of the insertion opening 51 when the toner bottle 2 is inserted from the insertion opening 51 and carried over the projection 152. This can reduce toner discharge failure for a long time without increasing a rotational load on the driving unit 200 during the rotational driving of the toner bottle 2.

Furthermore, the present embodiment includes the vibration intensity adjusting unit that adjusts the intensity of vibration generated with the projection 152 and the depression 23 by changing the projection amount T of the projection 152 according to the weight of the toner bottle 2. As illustrated in FIGS. 10 to 12, the vibration intensity adjusting unit adjusts the projection amount T of the projection 152 by elastically displacing the projection 152. Specifically, the projection 152 is formed independently from the inner wall face 51*a* of the insertion opening 51, which serves as an inner face of the interior portion and is supported by the interior portion 50 to be movable forward and backward in the direction a1 in which the projection 152 sticks out from the inner wall face 51*a* and in the direction a2 in which it returns back to the inner wall face 51*a* (see FIG. 12). A coil spring 153 as an elastic member is interposed between the inner wall face 51*a* of the interior portion 50 and the projection 152 to constitute the vibration intensity adjusting unit. Both ends of the coil spring 153 are fixed to the inner wall face 51*a* and the projection 152, respectively. The coil spring 153 biases the projection 152 in the sticking out direction a1. Even when a biasing force is applied from the coil spring 153 to the projection 152 toward the inner face 51*a*, a portion of the projection 152 is caught on the inner face 51*a* or the interior portion 50 so that the projection 152 is regulated not to exceed the maximum projection amount T1 illustrated in FIG. 12B.

When the toner bottle 2 is new and heavy because the inside of the bottle is full of toner, the biasing force by the coil spring 153 is set so that the projection 152 is pressed in the returning direction a2 by the self weight of the toner bottle 2 to have the minimum projection amount T2 as illustrated in FIG. 12A. The toner bottle 2 is gradually pushed up in the sticking out direction a1 by the biasing force by the coil spring 153 as the toner in the toner bottle 2 is consumed to reduce the weight of the toner bottle 2. The biasing force is set so that the projection amount reaches the maximum projection amount T1 as illustrated in FIG. 12B.

The projection 152 is movable forward and backward to the inner face 51*a* and is biased by the coil spring 153 in the sticking out direction a1. With this configuration, when there is a plenty of toner in the toner bottle 2 and the toner bottle 2 is heavy, the projection 152 is pushed down toward the inner face 51*a* to reduce the projection amount of the projection 152 as illustrated in FIG. 12A. Thus, small vibrations are applied to the toner bottle 2 in a state where the quantity of the remaining toner is large the aggregation and adhesion of the toner are small.

The pushing force from the toner bottle 2 decreases when the toner in the toner bottle 2 decreases to reduce the weight of the toner bottle 2. The projection 152 is then pushed up against the weight of the toner bottle 2 by the biasing force of the coil spring 153 in the direction a1 in which the projection 152 sticks out from the inner face 51*a* as illustrated in FIG. 12B. Thus, the projection amount T of the projection 152 is enlarged to apply strong vibrations to the toner bottle 2 in a state where the (quantity of the remaining toner in the toner bottle 2 is small and likely to cause the aggregation and adhesion of the toner.

The toner aggregated inside the toner bottle 2 and the toner adhering to the inner face of the bottle can be thrown off and toner discharge failure can be reduced while low costs and space savings are ensured. Furthermore, when the toner bottle 2 is heavy, the projection amount T of the projection 152 is small (the minimum projection amount T2). This can reduce the load on the toner bottle 2 caused by contact with the projection 152 during the rotational driving. The rotational load on the driving unit 200 during the rotational driving of the toner bottle 2 is eased to reduce toner discharge failure for a long time.

The coil spring 153 may be provided between the inner face 51*a* and the projection 152 in a replaceable manner. With such a replaceable coil spring 153, even when the weight of the toner bottle 2 is changed due to, for example, the modifications in the size, the material, and the toner of the toner bottle 2, the projection amount of the projection 152 can be adjusted to correspond to the modifications immediately, which enlarges the flexibility. The elastic member is not limited to the coil spring 153 and may be a leaf spring interposed between the inner face 51*a* and the projection 152, for example. Alternatively, although the projection 152 is independent from the coil spring 153 in the present embodiment, the projection 152 may be integrated into the elastic member by, for example, bending or pressing a leaf spring member and forming the projection 152 to be elastically displaceable.

Third Embodiment

Figure 13:
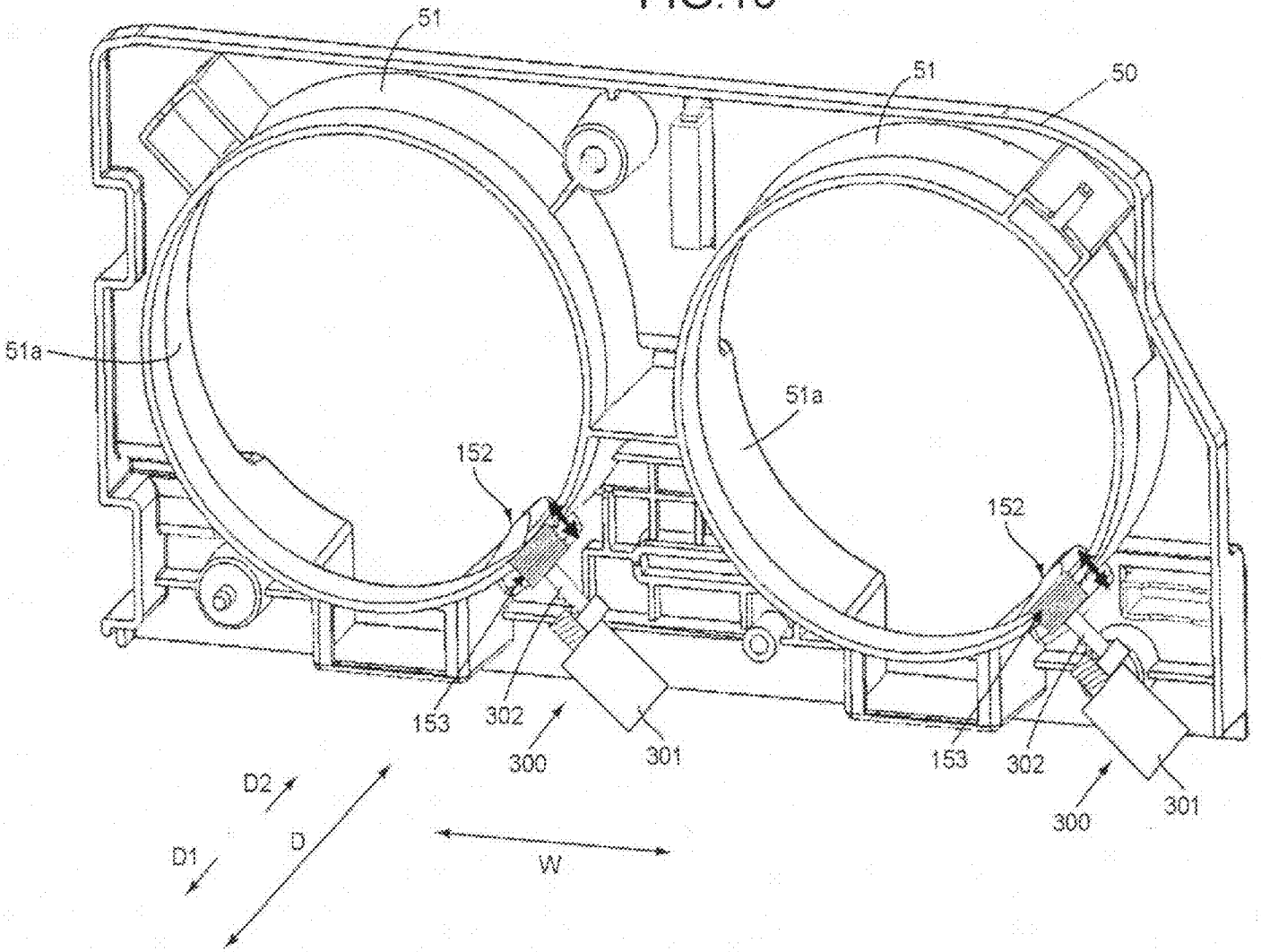
FIG. 13 is an enlarged perspective view illustrating a configuration of the main part of the toner supplying device including adjusting units, according to a third embodiment of the present invention.

The third embodiment is described with reference to FIGS. 13 and 14.

In the present embodiment, adjusting units 300 that increase and reduce the elastic force of the coil spring 153 according to the weight of the toner bottle 2 is added to the configuration of the second embodiment. The adjusting units 300 each include a driving motor 301 as a driving source and a rod 302 as a movable member that makes the coil spring 153 expand and contract in response to the rotational driving of the driving motor 301.

Figure 14A:
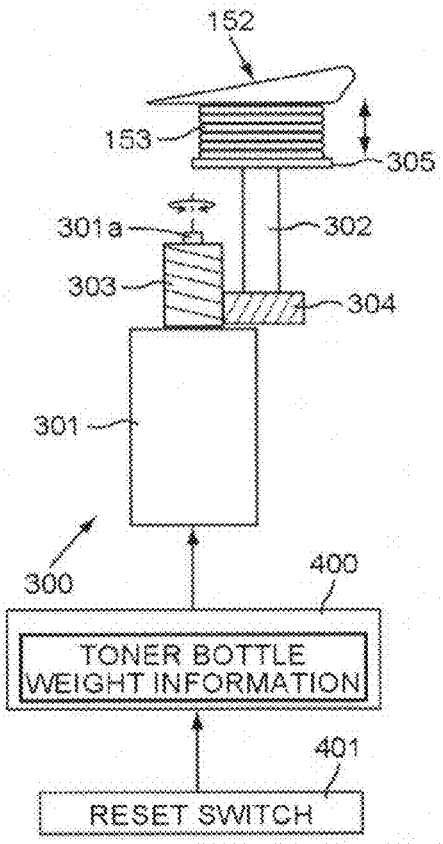
FIGS. 14A and 14B are diagrams illustrating a configuration and motion of the adjusting unit where
Figure 14B:
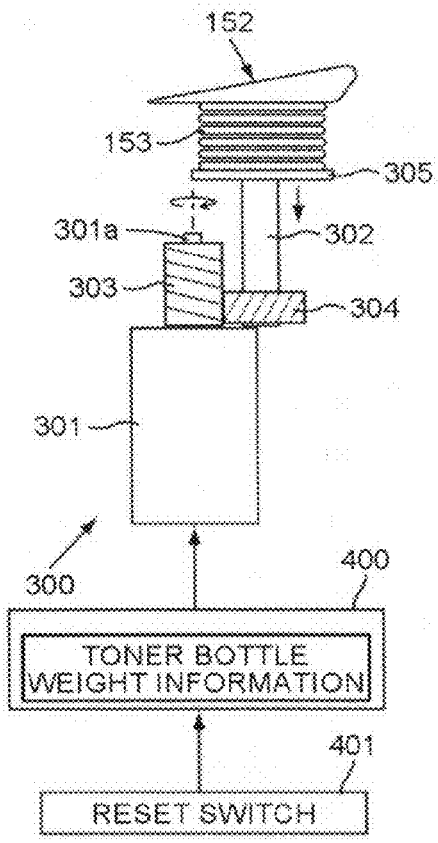

As illustrated in FIG. 14A, the driving motor 301 is a motor that is rotationally drivable in both forward and reverse directions. A driving gear 303 is fixed to a driving shaft 301*a* of the driving motor 301. A gear 304 engaging the driving gear 303 is provided at one end of the rod 302. A supporting portion 305 for fixing one end of the coil spring 153 is fixed to the other end of the rod 302. When the gear 304 is rotationally driven by the driving gear 303, the rod 302 reciprocates in the direction in which the coil spring 153 is compressed and in the direction the coil spring 153 is stretched as illustrated in FIG. 14B.

The driving motor 301 is connected with a controller 400 through a signal line and the controller 400 controls the driving of the driving motor 301. The controller 400 includes computers and controls the driving of the driving motor 301 according to toner bottle weight information. The toner bottle weight information is a correlation parameter between the consumption of toner and the change in the weight of the toner bottle 2 and includes the number of sheets printed. The toner in the toner bottle 2 is consumed in accordance with the increase in the number of sheets printed, whereby the toner bottle weight information indicates lighter weight.

In the present embodiment, a reset switch 401 that is operated after a new toner bottle 2 is installed in the toner supplying device 1 is connected through the signal line. When the reset switch 401 is operated, the toner bottle weight information is reset, and the maximum weight information corresponding to the installed toner bottle 2 is set in the controller 400 as an initial value. When the toner bottle weight information is reset, the controller 400 drives the driving motor 301 in the direction in which the coil spring 153 is compressed to be in the initial state. In the present embodiment, the initial state of the coil spring 153 indicates a state where it is compressed to the maximum. The weight of the toner bottle 2 may be measured for each type thereof beforehand to use the measurement value in the toner bottle weight information.

The controller 400 stores therein the toner bottle weight information on each predetermined number of sheets printed (1000 sheets, for example). When the number reaches the predetermined number, the controller 400 updates the toner bottle weight information and controls the coil spring 153 to be in the stretching direction by driving the driving motor 301 according to the updated toner bottle weight information.

The adjusting unit 300 that increases and reduces the elastic force of the coil spring 153 according to the weight of the toner bottle 2 is thus provided. With the heavy toner bottle 2, the coil spring 153 is compressed to enlarge the elastic force (spring force). The projection 152 supported by the coil spring 153 to be movable forward and backward is thus supported by the compressed coil spring 153 and is pushed down toward the inner face 51*a*. As illustrated in FIG. 12A, the projection amount T of the projection 152 becomes smaller than that when the toner bottle 2 is light. Smaller vibrations are applied to the toner bottle 2 in a state where the quantity of the remaining toner in the toner bottle 2 is large and the aggregation and adhesion of the toner are small.

However, when the predetermined number of sheets printed is reached, in other words, in accordance with the decrease in the weight of the toner bottle 2, the coil spring 153 is gradually stretched by driving the driving motor 301 to weaken the elastic force (spring force). The projection 152 supported by the coil spring 153 to be movable forward and backward is supported by the stretched coil spring 153 and thus is pushed up toward the inner face 51*a*. Therefore, as illustrated in FIG. 125, the projection amount T of the projection 152 becomes larger than that with the heavy toner bottle 2. Strong vibrations can be applied to the toner bottle 2 in a state where the quantity of the remaining toner in the toner bottle 2 is small and more likely to cause aggregation and adhesion of the toner.

The toner aggregated inside the toner bottle 2 and the toner adhering to the inner face of the bottle can be thrown off, and toner discharge failure can be reduced while low costs and space savings are ensured. Furthermore, when the toner bottle 2 is heavy, the projection amount T of the projection 152 is small. This can reduce the load on the toner bottle 2 caused by contact with the projection 152 during the rotational driving. The rotational load on the driving unit 200 during the rotational driving of the toner bottle 2 is eased to enhance the durability and to reduce toner discharge failure for a long time.

Specifically, in the present embodiment, the adjusting unit 300 increases and reduces the elastic force of the coil spring 153 according to the weight of the toner bottle 2. Even when the weight of the toner bottle is changed due to, for example, the modifications in the size, the material, and the toner of the toner bottle, a replacing operation or other operations for the elastic member 153 can be omitted to enlarge the flexibility.

The adjusting unit 300 may not use the driving motor 301. The adjusting unit 300 may use, for example, an electromagnetic actuator such as an electromagnetic solenoid as a driving source to cause the coil spring 153 to reciprocate in the compressing direction and the stretching direction by connecting a movable piece of the electromagnetic solenoid with the supporting portion 305 with a pin.

According to an embodiment, the interior portion for installing the toner container includes a projection having an inclination in which the projection amount increases toward downstream in the rotational direction of the toner container. The projection is formed to fall in the depression formed at the other end of the toner container. With this configuration, vibrations can be applied to the other end of the toner container by engaging and disengaging the projection in and from the depression during the rotational operation of the toner container. Without requiring a driving unit for vibration, this configuration can apply vibrations to the entire toner container in contrast to the case where vibrations are applied to the container at one end near the toner discharge opening, and thus, toner discharge failure can be reduced while low costs and space savings are ensured.

Although the invention has been described with respect to specific embodiments for a complete and clear disclosure, the appended claims are not to be thus limited but are to be construed as embodying all modifications and alternative constructions that may occur to one skilled in the art that fairly fail within the basic teaching herein set forth.

What is claimed is:

1. A toner supplying device comprising:

a toner container that is tubular, includes a spiral groove, a toner discharge opening at one end in a longitudinal direction of the toner container, and a depression at the other end in the longitudinal direction, and is rotationally driven to convey toner contained in the toner container along the spiral groove in the longitudinal direction to discharge the toner from the toner discharge opening;

a rotational driving unit that engages with the one end of the toner container to rotationally drive the toner container to cause the toner container to discharge the toner contained therein; and a projection provided at an interior portion at which the toner container is installed, and having an inclination in which a projection amount increases toward downstream in a rotational direction of the toner container, the toner supplying device supplying the toner discharged from the toner container to a developing device, wherein the projection goes into the depression of the toner container when the toner container rotates, and the projection has at least three faces, a first face including said inclination, a second face downstream in a rotational direction from the first face, the second face continuously contacting the toner container at an outer circumferential section of the toner container when the projection is not within the depression, and a third face downstream in a rotational direction from the second face.

2. The toner supplying device according to claim 1, wherein a length of a portion with a largest projection amount of the projection in the longitudinal direction is smaller than a length of a most recessed portion of the depression in the longitudinal direction.

3. The toner supplying device according to claim 1, wherein the projection is at a position that is shifted from a position vertically below a rotation axis of the toner container toward downstream in the rotational direction.

4. The toner supplying device according to claim 1, wherein the depression functions as a handle used for attaching and detaching the toner container.

5. The toner supplying device according to claim 1, wherein the projection amount of the projection is set such that a distance from an end of the projection to a portion of a wall face of the interior portion that is opposite to the end of the projection is smaller than a maximum diameter of the toner container.

6. The toner supplying device according to claim 1, wherein the projection has an inclination in which the projection amount increases in a detaching direction when the toner container is detached from the interior portion.

7. The toner supplying device according to claim 1, further comprising: a vibration intensity adjusting unit that adjusts an intensity of vibration generated with the projection and the depression.

8. The toner supplying device according to claim 7, wherein the vibration intensity adjusting unit adjusts the projection amount of the projection by elastically displacing the projection.

9. The toner supplying device according to claim 8, wherein the projection is at the interior portion to be movable forward and backward in a direction in which the projection sticks out from an inner face of the interior portion and in a direction in which the projection returns back to the inner face, and an elastic member is interposed between the interior portion and the projection.

10. The toner supplying device according to claim 9, wherein the elastic member is provided replaceably between the interior portion and the projection.

11. The toner supplying device according to claim 9, further comprising an adjusting unit that increases and reduces an elastic force of the elastic member according to a weight of the toner container.

12. An image forming apparatus comprising:

the toner supplying device according to claim 1;

a developing device to which toner is supplied from the toner supplying device; and an image forming unit that develops a latent image formed on a surface of an image bearer by the developing device to thereby form an image on the image bearer.

13. The toner supplying device according to claim 1, wherein:

the third face of the projection comprises two faces.

* * * * *